US006523610B1

(12) United States Patent
Griffith et al.

(10) Patent No.: US 6,523,610 B1
(45) Date of Patent: Feb. 25, 2003

(54) METHODS AND APPARATUS FOR FORMING METAL CASINGS IN WELL BORES

(75) Inventors: James E. Griffith, Duncan, OK (US); Jiten Chatterji, Duncan, OK (US); Ricky A. Cox, Comanche, OK (US); John L. Dennis, Jr., Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/189,944

(22) Filed: Jul. 3, 2002

(51) Int. Cl.[7] ..... E21B 29/02

(52) U.S. Cl. ..... 166/277; 166/302; 166/287; 166/288; 166/290; 166/57; 166/223

(58) Field of Search ..... 166/302, 57, 222, 166/223, 277, 284, 285, 288, 287, 290, 292

(56) References Cited

U.S. PATENT DOCUMENTS 3,638,730 A * 2/1972 Smith 4,561,300 A 12/1985 O'Brien ..... 73/154

FOREIGN PATENT DOCUMENTS

WO WO 01/66990 A1 9/2001 ..... F16L/55/10

* cited by examiner

*Primary Examiner*—Roger Schoeppel
(74) *Attorney, Agent, or Firm*—Craig W. Roddy; C. Clark Dougherty, Jr.

(57) ABSTRACT

Methods and apparatus for forming metal or metal alloy casings in well bores are provided. A method of the invention comprises the steps of providing and pumping a fluid suspension of a particulate metal or metal alloy into a pipe string within a well bore having a casing forming tool connected thereto. The casing forming tool includes an internal passageway sealingly communicated with the pipe string and with a plurality of radial openings in the tool positioned around the periphery thereof. An internal heater for heating the fluid suspension and melting the particulate metal or metal alloy and an internal rotating impeller for imparting centrifugal force to the fluid suspension are provided in the casing forming tool. Centrifugal force is imparted to the fluid suspension by the rotating impeller whereby the melted particulate metal or metal alloy forms a casing which solidifies on the walls of the well bore.

20 Claims, 1 Drawing Sheet

METHODS AND APPARATUS FOR FORMING METAL CASINGS IN WELL BORES

BACKGROUND OF THE INVENTION

1. Field of the Invention

The present invention relates to methods and apparatus for forming metal and metal alloy casings in well bores.

2. Description of the Prior Art

In the drilling and completion of well bores, hydraulic cement compositions are commonly used for cementing strings of metal pipe such as casings or liners in well bores. In such cementing operations, referred to in the art as primary cementing, a hydraulic cement composition is pumped into the annular space between the walls of a well bore and the exterior surfaces of a pipe string disposed therein. The cement composition is permitted to set in the annular space thereby forming an annular sheath of hardened substantially impermeable cement therein. The cement sheath physically supports and positions the pipe string in the well bore and bonds the exterior surfaces of the pipe string to the walls of the well bore whereby the undesirable migration of fluids between zones or formations penetrated by the well bore is prevented. While such primary cementing operations have been successful, they are generally time consuming and expensive.

Thus, there are continuing needs for improved methods of sealing well bores which are less time consuming and less expensive than the current practice of running casing and performing primary cementing operations.

SUMMARY OF THE INVENTION

The present invention provides methods and apparatus for forming metal casings in well bores which meet the needs described above and overcome the deficiencies of the prior art. The methods of this invention for forming metal casings in well bores are basically comprised of the following steps. A fluid suspension of a particulate metal or metal alloy having known melting and solidification temperatures is provided. The fluid suspension is pumped into a drill string or work string disposed within the well bore having a casing forming tool connected thereto. The casing forming tool includes an internal passageway sealingly communicated with the drill or work string and with a plurality of radial openings in the tool positioned around the periphery thereof. The fluid suspension of the particulate metal or metal alloy flows from the drill string or work string, through the casing forming tool and into contact with the walls of the well bore. The casing forming tool also includes an internal heater for heating the fluid suspension and melting the particulate metal or metal alloy as it flows through the tool. An internal rotating impeller for imparting centrifugal force to the fluid suspension as it flows through the tool is also disposed within the tool so that the melted particulate metal or metal alloy in the fluid suspension is deposited on the walls of the well bore and forms a casing which solidifies on the walls of the well bore. A sizing mandrel is attached to the casing forming tool for sizing the internal casing diameter of the solidifying metal or metal alloy. The pipe string and the casing forming tool are moved through the well bore while the fluid suspension is pumped through the pipe string and the casing forming tool at rates of movement and pumping whereby a solidified casing having a desired internal diameter is formed in the well bore.

The metal or metal alloy having known melting and solidification temperatures utilized depends on the well bore temperature. That is, a metal or metal alloy is utilized which has melting and solidifying temperatures above the highest temperature to be encountered in the well bore. The particular metal or metal alloy utilized is generally comprised of two or more metals selected from the group consisting of bismuth, tin, lead, antimony, mercury, cadmium silver, gallium, zinc, aluminum, copper, silicon, tellurium and indium. Non-alloyed metals such as tin alone, bismuth alone and lead alone can also be used.

The objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

Figure 1:
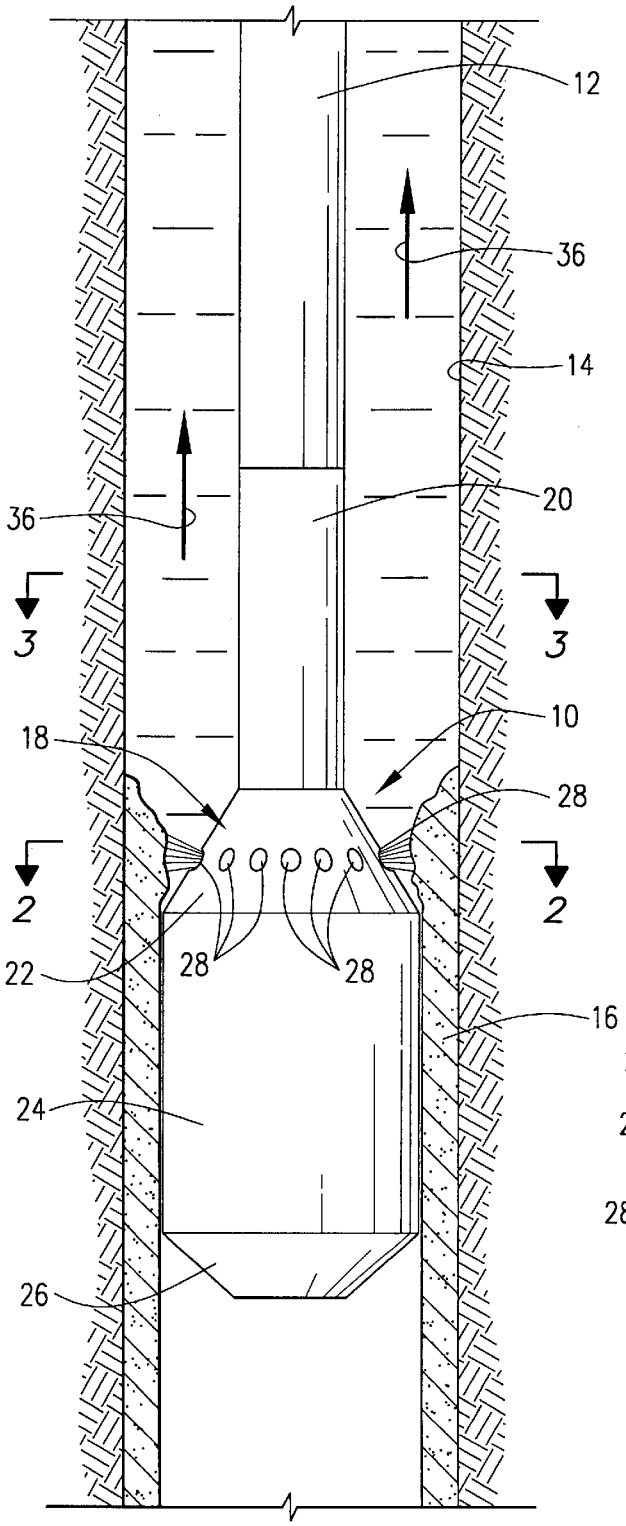
FIG. 1 is a side elevational view of a well bore having a metal or metal alloy casing forming tool of this invention disposed therein.

The present invention provides methods of forming metal or metal alloy casings in well bores and a metal or metal alloy casing forming tool which is utilized for carrying out the methods. The methods of the invention are basically comprised of the following steps. A fluid suspension of a particulate metal or metal alloy having known melting and solidification temperatures which are above the highest temperature in the well bore in which a casing is to be formed is provided. The fluid suspension is pumped into a drill or work string disposed within the well bore having a casing forming tool of this invention connected thereto. The casing forming tool includes an internal passageway sealingly communicated with the drill or work string and with a plurality of radial openings in the tool positioned around the periphery thereof through which the fluid suspension flows from the drill or work string into contact with the walls of the well bore. An internal heater for heating the fluid suspension and melting the particulate metal or metal alloy as it flows through the tool is included in the tool along with an internal rotating impeller for imparting centrifugal force to the fluid suspension as it flows through the tool. The fluid suspension containing the melted particulate metal or metal alloy therein is deposited on the walls of the well bore and forms a casing on the walls of the well bore as a result of the centrifugal force applied to the suspension. As the metal or metal alloy casing formed on the walls of the well bore solidifies, the internal casing diameter is sized by a sizing mandrel which is a part of the casing forming tool. The pipe string and the casing forming tool are moved through the well bore while the fluid suspension is pumped through the drill or work string and through the tool at rates of movement and pumping whereby a solidified casing having a desired internal diameter is formed therein.

The metals or metal alloys utilized in accordance with this invention generally have a melting temperature in the range of from about 90° F. to about 1500° F. and a solidifying temperature in the range of from less than about 1° F. to about 50° F. below the melting temperature.

A variety of metals or metal alloys including those often referred to as solders having various melting and solidifying temperatures can be utilized in accordance with the present invention. Generally, the terms "metal(s)" or "metal alloy (s)" are used herein to mean metals such as bismuth alone, tin alone and lead alone or metal alloys containing two or more of bismuth, tin, lead, antimony, mercury, cadmium, silver, gallium, zinc, aluminum, copper, silicon, tellurium and indium. However, other metals and metal alloys may be used. Examples of metals or metal alloys which can be utilized at temperatures in the range of from about 100° F. to about 1500° F. are set forth in Table I below.

TABLE I

| Metal Alloy[1], % by wt. | Liquidus Temp., ° F. | Solidus Temp., ° F. |
|---|---|---|
| 50 bismuth/25 tin/25 lead | 266 | — |
| 25 bismuth/50 tin/25 lead | 336 | — |
| 12.5 bismuth/37.5 tin/50 lead | 374 | — |
| 60 lead/40 tin | 460 | 361 |
| 85 lead/15 tin | 550 | 440 |
| 97.5 lead/2.5 silver | 588 | 588 |
| ~12 aluminum/~5 zinc/~83 magnesium | 1050 | 770 |
| ~8.8 aluminum/~2 zinc/~91.2 magnesium | 1110 | 830 |
| ~4 copper/~10 silicon/~86 aluminum | 1085 | 970 |

[1]Metal alloys and temperatures from the Handbook of Chemistry and Physics, 54th Edition, 1973–1974

Other examples of metals or metal alloys that can be utilized in accordance with this invention have melting points between about 76° F. and 351° F. These metals and metal alloys are set forth in Table II below.

TABLE II

| Metal Alloy[1], % by wt. | Melting Temp., ° F. | Composition, % by wt. | Melting Temp., ° F. |
|---|---|---|---|
| 48.5 bismuth/41.5 indium/10 cadmium | 76 | 99.41 tin/0.32 copper/0.27 aluminum | 234 |
| 52.34 indium/47.66 bismuth | 88 | 79.7 lead/17.7 cadmium/2.6 antimony | 239 |
| 52.5 bismuth/32 lead/15.5 tin | 96 | 84 lead/12 antimony/4 tin | 243 |
| 54 bismuth/26 tin/20 cadmium | 103 | 82.6 lead/17.4 cadmium | 249 |
| 67 bismuth/33 indium | 110 | 88.9 lead/11.1 antimony | 253 |
| 52 indium/48 tin | 118 | 97.3 bismuth/2.7 zinc | 256 |
| 56.5 bismuth/43.5 lead | 126 | 97.5 bismuth/2.5 silver | 263 |
| 56 bismuth/40 tin/4 zinc | 133 | 82.6 cadmium/17.4 zinc | 265 |
| 60 bismuth/40 tin | 139 | 100 bismuth[2] | 273 |
| 60 bismuth/40 cadmium | 147 | 91 lead/4.68 antimony/4.32 cadmium | 276 |
| 68.35 tin/29.25 cadmium/2.4 zinc | 159 | 92 gallium/18 magnesium | 285 |
| 71 tin/24 lead/5 zinc | 170 | 92.45 cadmium/7.55 antimony | 294 |
| 67.75 tin/32.25 cadmium | 175 | 96.97 lead/2.2 silver/0.83 antimony | 301 |
| 62.5 tin/36.15 lead | 180 | 97.5 lead/2.5 silver | 303 |
| 61.9 tin/38.1 lead | 184 | 97.55 lead/1.75 silver/0.7 tin | 311 |
| 91 tin/9 zinc | 198 | 98.1 lead/1 antimony/0.9 zinc | 315 |
| 91 tin/9 magnesium | 205 | 97.4 lead/2.6 tin | 320 |
| 95.8 tin/3.5 silver/0.7 copper | 218 | 98.76 lead/1.24 tin | 325 |
| 96.5 tin/3.5 silver | 222 | 100 lead[2] | 329 |
| 99.5 tin/0.5 aluminum | 229 | 92.97 zinc/4.08 aluminum/2.95 magnesium | 344 |
| 100 tin[2] | 231 | 70.6 tellurium/29.4 silver | 351 |

[1]Metal alloys and temperatures from U.S. Pat. No. 4,561,300 issued on Dec. 31, 1985.
[2]The term "metal alloy" is used herein to include metals such as tin alone, bismuth alone and lead alone.

Additional examples of metals or metal alloys that can be utilized in accordance with this invention having yield (melting) temperatures over the range of from about 105° F. to about 357° F. are set forth in Table III below.

TABLE III

| Metal Alloy[1], % by wt. | Yield Temp., ° F. |
|---|---|
| 42.91 bismuth/21.7 lead/7.97 tin/5.06 cadmium/18.33 indium/4 mercury | 105 |
| 49 bismuth/18 lead/12 tin/21 indium | 138 |

TABLE III-continued

| Metal Alloy[1], % by wt. | Yield Temp., ° F. |
|---|---|
| 50 bismuth/26.7 lead/13.3 tin/10 cadmium | 158 |
| 50.31 bismuth/39.2 lead/1.5 tin/7.99 cadmium/1 indium | 181 |
| 56 bismuth/22 lead/22 tin | 205 |
| 33.33 bismuth/33.34 lead/33.33 tin | 232 |
| 25.5 bismuth/14.5 lead/60 tin | 293 |
| 20 bismuth/50 lead/30 tin | 293 |
| 10 bismuth/40 lead/50 tin | 324 |
| 95 bismuth/5 tin | 357 |

[1]Metal alloys which are commercially available from Cerro Metal Products Co., Belefonte, Pennsylvania.

The fluid in the fluid suspension of a particulate metal or metal alloy utilized in accordance with this invention can be an aqueous or hydrocarbon base drilling fluid or other aqueous or hydrocarbon base fluid capable of suspending the particulate metal or metal alloy utilized at the temperatures encountered. The particulate metal or metal alloy is generally present in the fluid suspension in an amount in the range of from about 0.5% to about 25% by weight of the fluid in the suspension and more preferably in an amount of from about 5% to about 15%.

Referring now to the drawings, the metal or metal alloy casing forming tool of this invention is illustrated and generally designated by the numeral 10. The tool 10 is shown in FIG. 1 connected to a drill string or work string 12 within a well bore 14. The tool 10 is illustrated in FIG. 1 as it is being moved in the well bore 14 and is forming a metal or metal alloy casing 16 therein.

The metal or metal alloy well bore casing forming tool 10 is comprised of a housing 18 which includes an upper cylindrical portion 20 adapted to be connected to the drill string or work string 12, a conical central portion 22 and a lower enlarged cylindrical portion 24. The housing 18 is closed at its bottom end by a closure member 26. The housing 18 has a hollow interior which includes an internal passageway 21 (FIGS. 2 and 3 ) which is sealingly communicated with the drill string or work string 12 at one end and to a plurality of radial openings 28 in the conical central portion 22 of the housing 18. The radial openings are preferably positioned in a plane which is perpendicular to the vertical axis of the tool 10.

Figure 2:
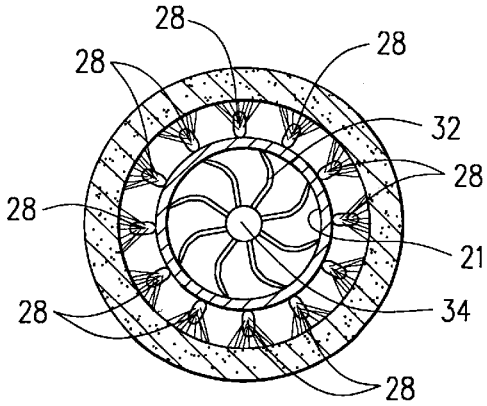
FIG. 2 is a cross-sectional view taken along line 2—2 of FIG. 1.
Figure 3:
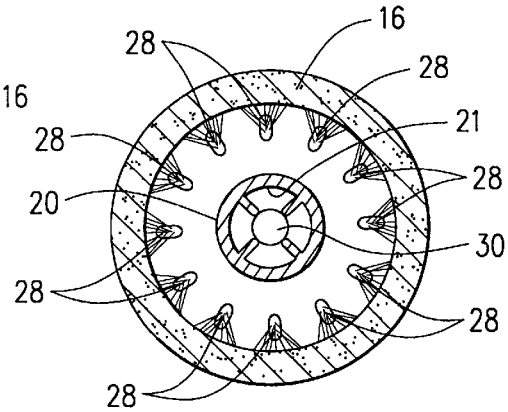
FIG. 3 is a cross-sectional view taken along line 3—3 of FIG. 1.

Referring now to FIG. 3, a heater 30 is disposed within the cylindrical portion 20 of the housing 18 which functions to heat the fluid suspension of particulate metal or metal alloy to the temperature required to melt the metal or metal alloy. The heater 30 can be powered by electric current from batteries disposed within the housing 18 or by a wire line or the equivalent means (not shown). After flowing past the heater 30, the fluid suspension containing the melted metal or metal alloy flows into an internal rotating impeller 32 driven by an electric motor 34 as shown in FIG. 2. The electric motor 34 and impeller 32 are located in the truncated conical section 22 of the housing 18 in the same plane as the radial openings 28. The rotating impeller 32 functions to impart centrifugal force to the fluid suspension and melted metal or metal alloy whereby the fluid suspension and melted metal or metal alloy therein are discharged by way of the radial openings 28 against the wall of the well bore 14 as shown in FIG. 1. The centrifugal force applied to the suspension causes the melted metal or metal alloy 16 to be deposited on the walls of the well bore as shown in FIG. 1. The electric motor 34 is powered by electric current as described above in connection with the heater 30.

As a result of the centrifugal force applied to the fluid suspension exiting the radial openings 28 in the housing 18, the melted metal or metal alloy is separated from the fluid and the fluid flows upwardly in the well bore 14 as shown by the arrows 36.

The enlarged cylindrical portion 24 of the housing 18 functions as an external mandrel for sizing the internal diameter of the metal or metal alloy casing as the casing forming tool 10 is moved through the well bore 14.

The casing forming tool 10 is moved in the vertical well bore 14 illustrated in FIG. 1 from a lower point where the metal or metal alloy casing is started to an upper point in the well bore 14 where the metal or metal alloy casing ends. As will be understood, while the casing forming tool 10 is moved upwardly the fluid suspension containing melted metal or metal alloy is continuously pumped through the casing forming tool 10 and the melted metal or metal alloy deposits on the walls of the well bore 14. The rate that the casing forming tool 10 is moved and the rate of pumping the fluid suspension are controlled whereby a metal or metal alloy casing is formed on the walls of the well bore 14 having a desired internal diameter. As will also be understood by those skilled in the art, the methods and casing forming tool of this invention can be utilized in deviated and horizontal well bores as well as in vertical well bores. A conventional centralizing apparatus (not shown) can be used with the tool 10 or made a part thereof to maintain the tool in the center of the well bore. Also, as will be understood by those skilled in the art, the tool 10 can be modified whereby it can be moved in either direction in a vertical, deviated or horizontal well bore, e.g., additional radial openings 28 can be located in the closure member 26 of the housing 18 and the tool 10 can include a valve mechanism (not shown) for switching the flow of melted metal alloy between the two sets of openings.

A preferred method of the present invention for forming a metal or metal alloy casing in a well bore is comprised of the steps of: (a) providing a fluid suspension of a particulate metal or metal alloy having known melting and solidification temperatures; (b) pumping the fluid suspension into a drill or work string disposed within the well bore having a casing forming tool connected thereto, the casing forming tool including an internal passageway sealingly communicated with the drill or work string and with a plurality of radial openings in the tool positioned around the periphery thereof, an internal heater for heating the fluid suspension and melting the particulate metal or metal alloy as it flows through the tool, an internal rotating impeller for imparting centrifugal force to the fluid suspension as it flows through the radial openings of the tool whereby the melted particulate metal or metal alloy therein forms a casing which solidifies on the walls of the well bore and an internal casing diameter sizing mandrel attached to the tool for sizing the solidifying metal or metal alloy; and (c) moving the pipe string and the casing forming tool through the well bore while pumping the fluid suspension through the pipe string and the tool at rates of movement and pumping whereby a solidified casing having a desired internal diameter is formed therein.

Another preferred method of this invention for forming a metal or metal alloy casing in a well bore comprises the steps of: (a) providing an aqueous suspension of a particulate metal or metal alloy having known melting and solidification temperatures and being comprised of bismuth alone, tin alone or lead alone or of two or more metals selected from the group consisting of bismuth, tin, lead, antimony, mercury, cadmium, silver, gallium, zinc, aluminum, copper, silicon, tellurium and indium; (b) pumping the fluid suspension into a drill or work string disposed within the well bore having a casing forming tool connected thereto, the casing forming tool including an internal passageway sealingly communicated with the pipe string and with a plurality of radial openings in the tool positioned around the periphery thereof, an internal heater for heating the fluid suspension and melting the particulate metal or metal alloy as it flows through the tool, an internal rotating impeller for imparting centrifugal force to the fluid suspension as it flows through the radial openings of the tool whereby the melted particulate metal or metal alloy therein forms a casing which solidifies on the walls of the well bore and an internal casing diameter sizing mandrel attached to the tool for sizing the solidifying metal or metal alloy; and (c) moving the pipe string and the casing forming tool through the well bore while pumping the fluid suspension through the drill or work string and the tool at rates of movement and pumping whereby a solidified casing having a desired internal diameter is formed therein.

A preferred metal or metal alloy casing forming tool into which a fluid suspension of particulate metal or metal alloy is pumped comprising:

- a housing adapted to be connected to a drill or work string, the housing having an internal passageway sealingly communicated with the drill or work string and sealingly communicated with a plurality of radial openings in the housing positioned around the periphery thereof;
- an internal heater disposed within the passageway in the housing for heating the fluid suspension of the metal or metal alloy whereby the metal or metal alloy is melted;
- an internal rotating impeller disposed within the passageway in the housing for imparting centrifugal force to the fluid suspension containing the melted metal or metal alloy and discharging the fluid suspension through the radial openings of the tool against the walls of the well bore whereby a metal or metal alloy casing is formed on the walls of the well bore and solidifies thereon; and
- the housing having an external mandrel portion for sizing the internal diameter of the metal or metal alloy casing as the tool is moved through the well bore.

Thus, the present invention is well adapted to carry out the objects and attain the end and advantages mentioned as well as those which are inherent therein. While numerous changes can be made by those skilled in the art, such changes are encompassed within the spirit of this invention as defined by the appended claims.

What is claimed is:

1. A method of forming a metal or metal alloy casing in a well bore comprising the steps of:

(a) providing a fluid suspension of a particulate metal or metal alloy having known melting and solidification temperatures;

(b) pumping said fluid suspension into a drill or work string disposed within said well bore having a casing forming tool connected thereto, said casing forming tool including an internal passageway sealingly communicated with said drill or work string and with a plurality of radial openings in said tool positioned around the periphery thereof, an internal heater for heating said fluid suspension and melting said particulate metal or metal alloy as it flows through said tool, an internal rotating impeller for imparting centrifugal force to said fluid suspension as it flows through said radial openings of said tool whereby said melted particulate metal or metal alloy therein forms a casing which solidifies on the walls of said well bore and an internal casing diameter sizing mandrel attached to said tool for sizing the solidifying metal or metal alloy; and (c) moving said pipe string and said casing forming tool through said well bore while pumping said fluid suspension through said pipe string and said tool at rates of movement and pumping whereby a solidified casing having a desired internal diameter is formed therein.

2. The method of claim 1 wherein said metal or metal alloy has a melting temperature in the range of from about 90° F. to about 1500° F. and a solidifying temperature in the range of from less than about 1° F. to about 50° F. below said melting temperature.

3. The method of claim 2 wherein said metal or metal alloy is comprised of bismuth.

4. The method of claim 2 wherein said metal or metal alloy is comprised of tin.

5. The method of claim 2 wherein said metal or metal alloy is comprised of lead.

6. The method of claim 2 wherein said metal or metal alloy is comprised of two or more metals selected from the group consisting of bismuth, tin, lead, antimony, mercury, cadmium, silver, gallium, zinc, aluminum, copper, silicon, tellurium and indium.

7. The method of claim 1 wherein said fluid in said fluid suspension is an aqueous or hydrocarbon base fluid.

8. The method of claim 1 wherein said fluid in said fluid suspension is an aqueous or hydrocarbon base drilling fluid.

9. The method of claim 1 wherein said particulate metal or metal alloy is present in said fluid suspension in an amount in the range of from about 0.5% to about 25% by weight of said fluid suspension.

10. A method of forming a metal or metal alloy casing in a well bore comprising the steps of:

(a) providing an aqueous or hydrocarbon base fluid suspension of a particulate metal or metal alloy having known melting and solidification temperatures and being comprised of bismuth alone, tin alone or lead alone or of two or more metals selected from the group consisting of bismuth, tin, lead, antimony, mercury, cadmium, silver, gallium, zinc, aluminum, copper, silicon, tellurium and indium;

(b) pumping said fluid suspension into a drill or work string disposed within said well bore having a casing forming tool connected thereto, said casing forming tool including an internal passageway sealingly communicated with said pipe string and with a plurality of radial openings in said tool positioned around the periphery thereof, an internal heater for heating said fluid suspension and melting said particulate metal or metal alloy as it flows through said tool, an internal rotating impeller for imparting centrifugal force to said fluid suspension as it flows through the radial openings of said tool whereby said melted particulate metal or metal alloy therein forms a casing which solidifies on the walls of said well bore and an internal casing diameter sizing mandrel attached to said tool for sizing the solidifying metal or metal alloy; and (c) moving said pipe string and said casing forming tool through said well bore while pumping said fluid suspension through said drill or work string and said tool at rates of movement and pumping whereby a solidified casing having a desired internal diameter is formed therein.

11. The method of claim 10 wherein said fluid in said fluid suspension is an aqueous or hydrocarbon base fluid.

12. The method of claim 10 wherein said fluid in said fluid suspension is an aqueous or hydrocarbon base drilling fluid.

13. The method of claim 10 wherein said particulate metal or metal alloy is present in said fluid suspension in an amount in the range of from about 0.5% to about 25% by weight of said fluid suspension.

14. A metal or metal alloy casing forming tool into which a fluid suspension of particulate metal or metal alloy is pumped comprising:

a housing adapted to be connected to a drill or work string, said housing having an internal passageway sealingly communicated with said drill or work string and sealingly communicated with a plurality of radial openings in said housing positioned around the periphery thereof;

an internal heater disposed within said passageway in said housing for heating said fluid suspension of said metal or metal alloy whereby said metal or metal alloy is melted;

an internal rotating impeller disposed within said passageway in said housing for imparting centrifugal force to said fluid suspension containing said melted metal or metal alloy and discharging said fluid suspension through said radial openings of said tool against said walls of said well bore whereby a metal or metal alloy casing is formed on said walls of said well bore and solidifies thereon; and said housing having an external mandrel portion for sizing the internal diameter of said metal or metal alloy casing as said tool is moved through said well bore.

15. The casing forming tool of claim 14 wherein said internal heater is powered by electric current.

16. The casing forming tool of claim 14 wherein said internal rotating impeller is powered by electric current.

17. The casing forming tool of claim 14 wherein said housing is substantially cylindrical.

18. The casing forming tool of claim 14 wherein said external mandrel portion of said housing is cylindrical.

19. The casing forming tool of claim 14 wherein said plurality of radial openings positioned around the periphery of said housing are positioned in a plane which is substantially perpendicular to the axis of said tool.

20. The casing forming tool of claim 14 wherein said plurality of radial openings positioned around the periphery of said housing are recessed from said mandrel portion of said housing.

* * * * *